US006032138A

United States Patent [19]

McFiggans et al.

[11] Patent Number: 6,032,138

[45] Date of Patent: Feb. 29, 2000

[54] METERING INCOMING DELIVERABLE MAIL

[75] Inventors: Robert B. McFiggans, Stamford; Ronald P. Sansone, Weston, both of Conn.

[73] Assignee: Pitney Bowes Inc., Stamford, Conn.

[21] Appl. No.: 08/924,668

[22] Filed: Sep. 5, 1997

[51] Int. Cl.[7] ..... G07B 17/00

[52] U.S. Cl. ..... 705/410; 705/401; 705/408

[58] Field of Search ..... 382/101; 392/200.35; 705/400, 401, 408, 410; 707/100, 104; 709/206

[56] References Cited

U.S. PATENT DOCUMENTS

| | | | |
|---|---|---|---|
| 4,637,051 | 1/1987 | Clark | 382/101 |
| 4,641,346 | 2/1987 | Clark et al. | 380/3 |
| 4,641,347 | 2/1987 | Clark et al. | 380/3 |
| 4,752,950 | 6/1988 | Le Carpentier | 705/410 X |
| 4,800,504 | 1/1989 | Durst, Jr. et al. | 705/408 X |
| 4,835,713 | 5/1989 | Pastor | 705/408 X |
| 4,934,846 | 6/1990 | Gilham | 705/408 X |
| 5,043,908 | 8/1991 | Manduley et al. | 364/478.15 |
| 5,072,400 | 12/1991 | Manduley | 364/478.14 |
| 5,375,172 | 12/1994 | Chrosny | 705/408 X |
| 5,635,694 | 6/1997 | Tuhro | 235/375 |
| 5,770,841 | 6/1998 | Moed et al. | 235/375 |
| 5,790,790 | 8/1998 | Smith et al. | 395/200.36 |
| 5,819,241 | 10/1998 | Reiter | 705/408 |

*Primary Examiner*—Edward R. Cosimano
*Attorney, Agent, or Firm*—Ronald Reichman; Melvin J. Scolnick

[57] ABSTRACT

A system in which originating mail processors would upload pertinent mail piece information on addressees, pointers or other identifiers automatically and periodically to a data center. The recipient addressee of the mail piece would temporarily configure his digital postage meter or mail processor as a mail receiver so that the postage meter or mail processor would read the digital indicia that was affixed to the currently delivered incoming mail. The incoming mail would be date/time stamped, opened (optionally) and the unique identifier that was placed in the postal indicia would be read. The recipient meter or mail processor would periodically upload to the data center raw data on the unique identifiers or codes that have been received. If the received unique identifiers or codes match with the sender unique identifiers or codes in a reasonable amount of time, as would normally be the case, the sent and received codes cancel out, or are kept for statistical information on delivery times, etc. Non-matched codes could be flagged and reported to the originator for further investigation. Thus, the data center may be able to locate mis-sent or mis-routed mail and automatically feed back information on undelivered or undeliverable mail.

38 Claims, 9 Drawing Sheets

METERING INCOMING DELIVERABLE MAIL

CROSS REFERENCE TO RELATED APPLICATIONS

Reference is made to commonly assigned co-pending patent application Ser. No. 08/924,789 filed herewith entitled "Metering Incoming Mail to Determine Fraudulent Indicia" in the names of Ronald Sansone and Robert McFiggans; Ser. No. 08/924,793 filed herewith entitled "Metering Incoming Deliverable Mail To Identify Delivery Delays" in the names of Ronald Sansone and Robert McFiggans Ser. No. 08/924,860 filed herewith entitled "Metering Incoming Deliverable Mail To Automatically Enable Address Correction" in the names of Ronald Sansone and Robert McFiggans.

FIELD OF THE INVENTION

The invention relates generally to the field of messaging systems and more particularly to messaging systems that utilize postage meters and a centralized or distributed data processing center.

BACKGROUND OF THE INVENTION

Historically postage meters have been mechanical and electromechanical devices that: maintain through mechanical or "electronic registers" (postal security devices) an account of all postage printed and the remaining balance of prepaid postage; and print postage postmarks (indicia) that are accepted by the postal service as evidence of the prepayment of postage.

Soon small business mailers may be able to use their desktop computer and printer to apply postage directly onto envelopes or labels while applying an address. The United States Postal Service Engineering Center recently published a notice of proposed specification that may accomplish the foregoing. The title of the specification is Information Based Indicia Program Postal Security Device Specification, dated Jun. 13, 1996, herein incorporated by reference. The Information Based Indicia Program specification includes both proposed specifications for the new indicium and proposed specifications for a postal security device (PSD). The proposed Information-Based Indicia (IBI) consists of a two dimensional bar code containing hundreds of bytes of information about the mail piece and certain human-readable information. The indicium includes a digital signature to preclude the forgery of indicia by unauthorized parties. The postal security device is a security device that produces a cryptographic digital signature for the indicium and performs the function of postage meter registers.

There are approximately one and a half million postage meters in use in the United States, accounting for about twenty billion dollars of postage revenue annually. The United States Postal Service (USPS) is authorized to regulate the manufacture and use of postage meters. For the past several years, the United States Postal Service has been actively proposing a solution to the problem of inadequate postage meter security. The United States Postal Service is also trying to solve the problem that currently available postal meter indicia are susceptible to counterfeiting. The United States Postal Service plans to solve the above problems by decertifying mechanical meters and implementing the Information-Based Indicia Program (IBIP).

The IBIP is a United States Postal Service initiative supporting the development and implementation of a new form of postal indicia. The IBIP specification is intended to address the counterfeiting threat. An IBIP indicium substitutes for a postage stamp or as a postage meter imprint as evidence of the fact that postage has been paid on mail pieces. The Information-Based Indicia technology of the United States Postal Service offers the postal customer a way to pay for postage without stamps. Envelopes may be franked using the postal customer's personal computer, a personal computer compatible add-on and the customer's printer. The PSD provides postal value storage and the link to the USPS and the manufacturer of the personal computer compatible add-on. The IBI should be able to be read at any time to verify that funds have been paid.

The United States Postal Service currently handles large volumes of normal mail, i.e., first class mail, second class mail and third class mail. The post delivers normal mail and the post and sender of normal mail are unaware of the time that the addressee received the normal mail. If the sender of mail wants to know that the mail was delivered to a particular address and/or addressee, the sender may use the Post's expensive certified or registered mail service.

SUMMARY OF THE INVENTION

This invention overcomes the disadvantages of the prior art by providing a system that indicates when normal digital postage meter mail or PSD mail is received by an addressee. The foregoing is accomplished by connecting a scanner and control software to a digital postage meter or PSD mail processor that would read incoming digitally metered mail. Instead of printing an indicia, the scanner would read the already existing indicia and other information on the mail piece and then extract the sender data fields that are contained in the indicia or on the mail piece. The extracted mail data would be periodically uploaded to a data center. The data center would compare the extracted data with mail sender data that has previously been uploaded from sending meters and processors to determine the delivery time of particular mail pieces.

In essence, originating meters and PSD mail processors would upload pertinent mail piece information on addressees, pointers or other identifiers automatically and periodically to a data center. The recipient addressee of the mail piece would temporarily configure his digital postage meter or postal security device mail processor as a mail receiver so that the postage meter or mail processor would read the digital indicia that was affixed to the currently delivered incoming mail. The incoming mail would be date/time stamped, opened (optionally) and the unique identifier that was placed in the postal indicia would be read. The recipient meter or mail processor would periodically upload to the data center raw data on the unique identifiers or codes that have been received. If the received unique identifiers or codes match with the sender unique identifiers or codes in a reasonable amount of time, as would normally be the case, the sent and received codes cancel out, or are kept for statistical information on delivery times, etc. Non-matched codes could be flagged and reported to the originator for further investigation. Thus, the data center may be able to locate mis-addressed or mis-routed mail and automatically feed back information on undelivered or undeliverable mail.

DETAILED DESCRIPTION OF THE PREFERRED EMBODIMENT

Figure 1:
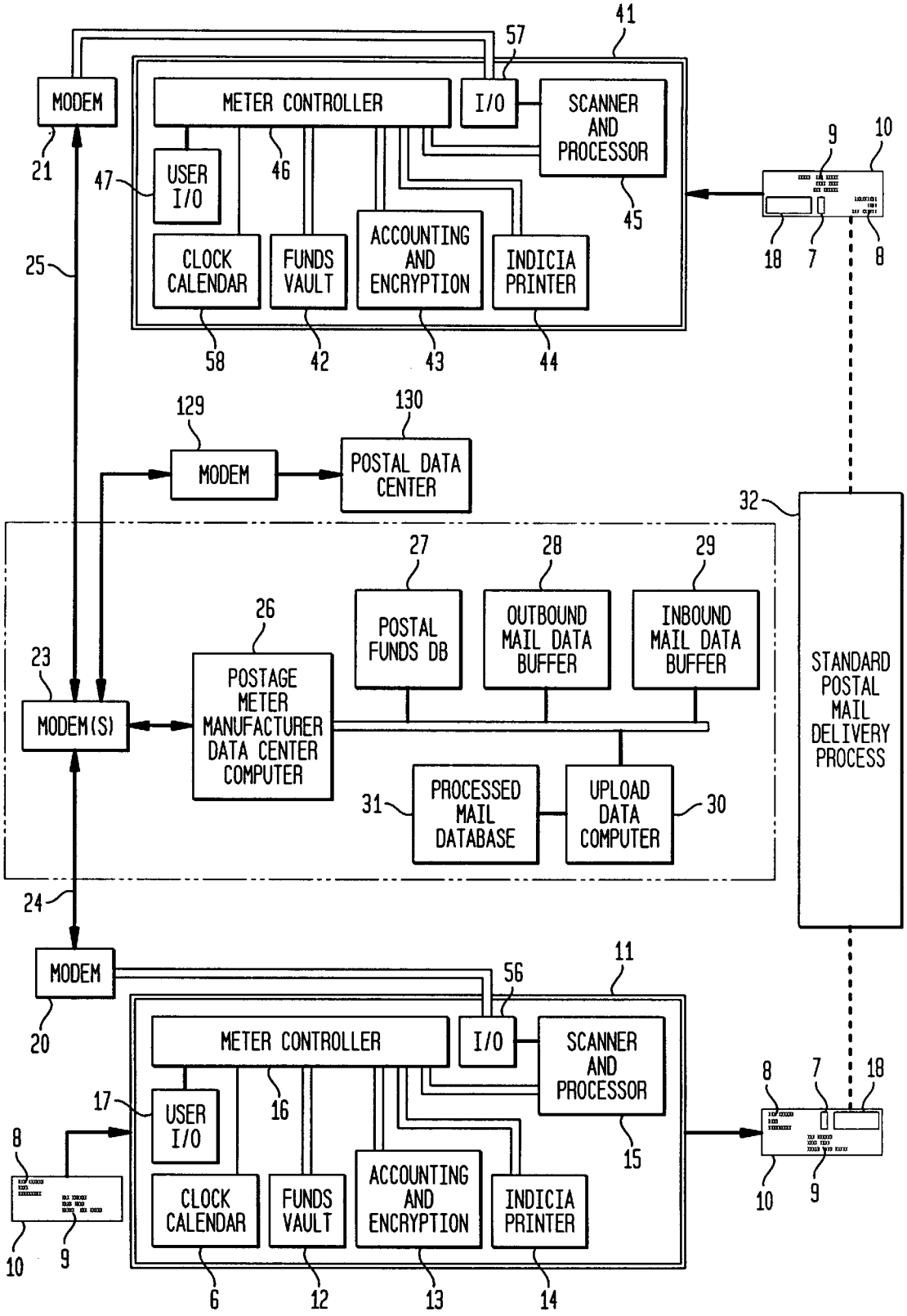
FIG. 1 is a block diagram of this invention.

Referring now to the drawings in detail, and more particularly to FIG. 1, the reference character 11 represents a electronic postage meter. Postage meter 11 includes: a funds vault 99, that represents the value of the postage that may be used by meter 11; a accounting and encryption module 13, that contains information that is used to print indicia 18; a printer 14; a scanner and processor 15; a controller 16; a clock and calendar 6; a user I/O 17, and a I/O 56. Accounting and encryption module 13 obtains a security code that may be obtained from address field 9 of mail piece 10 and information contained in postage meter 11. The manner in which the aforementioned security code is obtained is disclosed in the Sansone et al U.S. Pat. No. 4,831,555 entitled "Unsecured Postage Applying System" herein incorporated by reference. User I/O 17 comprises a keyboard in which an operator may enter information into meter 11 and a display in which a operator of meter 11 may read information about meter 11. Funds vault 99, accounting and encryption module 13, indicia printer 14, scanner and processor 15, clock and calendar 6, and user I/O 17 are coupled to controller 16. Clock and calendar 6 provides an internal source of time and date for controller 16. Thus, clock and calendar 6 will supply the instant date and time that meter 11 affixed the indicia to mail piece 10. Scanner and processor 15 will store the above information in buffer 54 (described in the description of FIG. 2).

Actions performed by meter 11 are communicated to controller 16. Controller 16 controls the actions of postage meter 11. Clock and calendar 6 also permit controller 16 to store the date and time that postal indicia 18 was affixed to mail piece 10. Controller 16 uses the weighing of the mail piece to determine the correct postage, and causes meter 11 to affix the correct postage to the mail piece. Controller 16 is described in Wu's U.S. Pat. No. 5,272,640 entitled "Automatic Mail-Processing Device With Full Functions" herein incorporated by reference.

The user of meter 11 places the mail piece to be mailed on a scale (not shown) and enters the classification of the material to be mailed, i.e., first class mail, second class mail, parcel post, etc., into the keyboard of I/O 17 and relevant information regarding the object to be mailed is displayed on the display of I/O 17.

Printer 14 will print postal indicia 18 on mail piece 10. Scanner and processor 15 scans address field 9 and sender return address field 8 of mail piece 10. Then scanner and processor 15 segments the information contained in fields 8 and 9 and stores the segmented information i.e., tracking code 7. Tracking code 7 may be similar to or the same as the security code determined by accounting encryption module 13. It will be obvious to one skilled in the art that there are many different methods to produce unique tracking numbers.

I/O 56 is coupled to modem 20 and scanner and processor 15. Modem 23 is coupled to modem 20 via communications path 24 and modem 21 is coupled to modem 23 via communications path 25. Modem 23 is coupled to postage meter data center computer 26. Computer 26 manages the day to day operation of its postage meters metering i.e., installing new postage meters, withdrawing postage meters, and refilling postage meters with customer funds.

Computer 26 is coupled to: postal funds data base 27. Data base 27 stores postal funds that have been used and credited to meters 11 and 41. Outbound mail data buffer 28 receives information about mail piece 10 from postage meter 11, i.e., tracking number 7 and address field 9. Inbound mail buffer 29 receives information about mail piece 10 from postage meter 41, i.e., tracking number 7 and address field 9. Upload data computer 30 receives and processes information from buffers 28 and 29. Processed mail data base 31 is coupled to upload data computer 30. Processed mail data base 31 stores the result of the output of computer 30 and makes it available to computer 26 for transmission to meter 11. Modem 23 is coupled to modem 129 which is coupled to postal data center 130 so that information from upload data computer 30 may be transmitted to postal data center 130.

Postage meter 41 includes: a funds vault 42, that represents the value of the postage that may be used by meter 41; an accounting and encryption module 43, that contains information that is used to print postal indicia; a printer 44; a scanner and processor 45; a controller 46; a clock and calendar 58 that permits controller 46 to store the date and time that scanner 45 scanned mail piece 10; a user I/O 47; and an I/O 57. Funds vault 42, accounting and encryption module 43; indicia printer 44; scanner and processor 45, and user I/O 47 are coupled to controller 46. I/O 57 is the interface between scanner and processor 45 and modem 21 and is used to upload data from meter 41 to computer 26 via modems 21 and 23. Clock and calendar 58 will supply the instant date and time that scanner 45 reads mail piece 10. The above information will be stored in buffer 54 of FIG. 2. Printer 44 will print on mail piece 10 the date and time that scanner 45 read mail piece 10.

Thus, meter 41 is the same as meter 11. In this example, meter 41 is being used as the receiving meter and meter 11 is being used as a sending meter. It will be obvious to those skilled in the art that meter 11 may be a receiving meter and meter 41 a sending meter and that additional meters may be connected to computer 26.

After indicia 18 is affixed to mail piece 10 by postage meter 11, mail piece 10 is delivered to the post and enters USPS mail delivery process 32. The post delivers mail piece 10 to the owner of electronic postage meter 41. Mail piece 10 will be scanned by scanner and processor 45 of meter 41. Scanner and processor 45 segments the data and stores it for uploading to computer 26 via modems 21 and 23. Information from meter 11 regarding mail piece 10 was previously sent to computer 26 via modems 20 and 23. The information transmitted by meter 11 is tracking number 7 and address field 9. The information transmitted by meter 41 is tracking number 7 and address field 9, the date and time mail piece 10 was scanned by meter 41 and the serial number of meter 41. Upload data computer 30 determines the amount of time that has elapsed between the time the postal indicia was affixed to the mail piece and the time that the recipient meter scanned the postal indicia. Upload data computer 30 also informs the mailer and the post of the amount of time that has elapsed between the time the postal indicia was affixed to the mail piece and the time that the recipient unit read the mail piece. There may be a fee for the above service. The above service may be charged for. Upload data computer 30 may also inform the mailer and the post of mail pieces that have not been read by recipient's units after specified periods of time. Other information may be routed by the data center to the mailer and the post and the mailer and post may be charged for this service.

Figure 2:
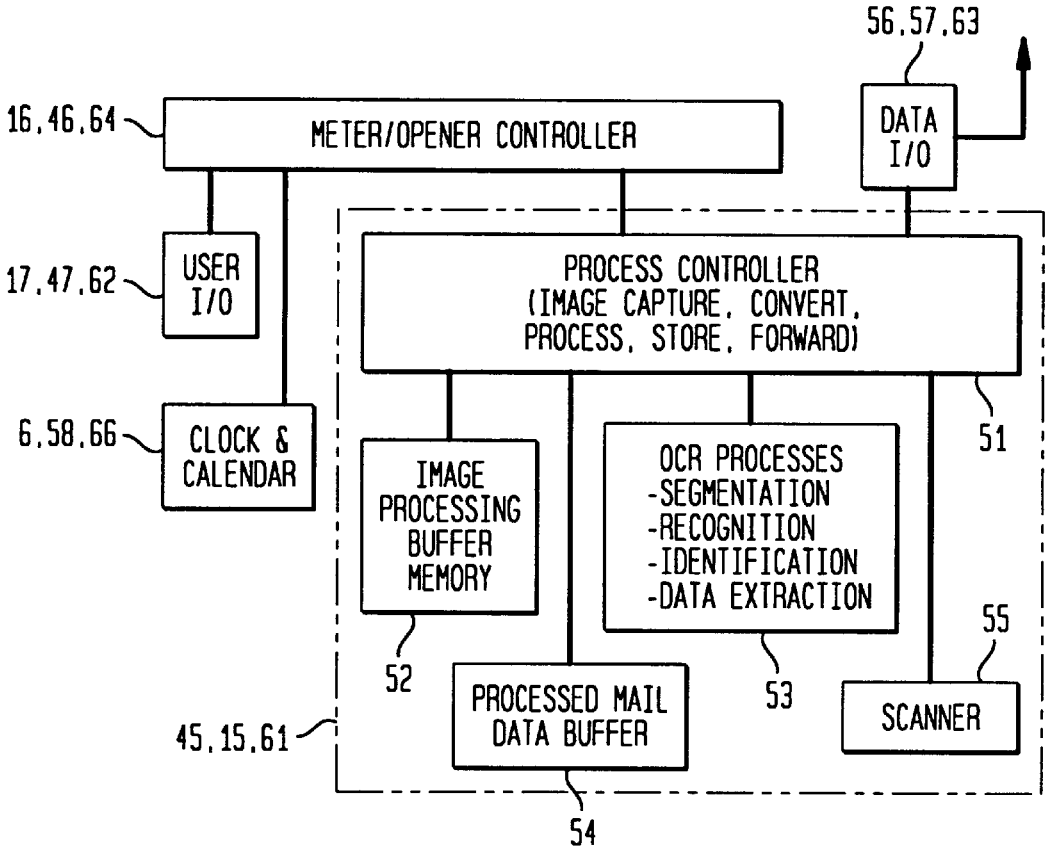
FIG. 2 is a drawing of scanner and data processors 15 and 45 of FIG. 1 in greater detail.
Figure 8:
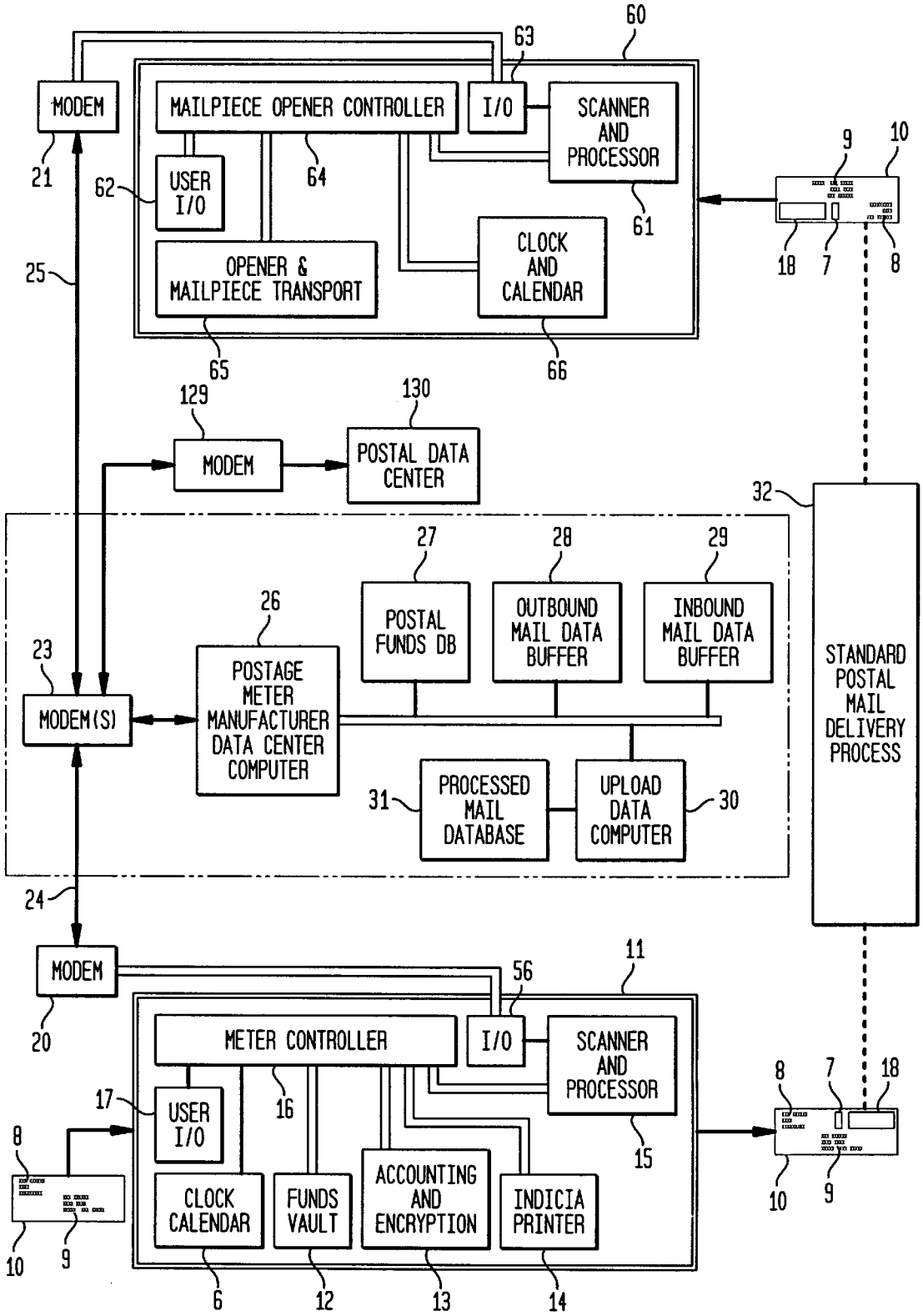
FIG. 8 is a block diagram of an alternate embodiment of this invention.

FIG. 2 is a drawing of scanner and data processors 15 and 45 of FIG. 1 and scanner and processor 61 of FIG. 8 in greater detail. The operator of meter 41 may use I/O 47 to select the meter mode to place a postal indicia on mail piece 10 or the scan mode to read the postal indicia on mail piece 10. When the operator of meter 41 selects the scan mode, controller 46 turns control of meter 41 over to scan process controller 51. Mail piece 10 will be moved under scanner 55 and transported through meter 41 (not shown). Scanner 55 will store the image of mail piece 10 in buffer 52, convert the image by using the process mentioned in block 53 and store the processed image in processed mail data buffer 54. Then the optical character recognition process 53 will begin. Process 53 will segment the image into its various components, i.e., amount of postage, meter number, date mail piece 10 mailed, place mail piece 10 mailed, security code 89, tracking number 7, recipient address 9, and return address 8, etc. At this point, a recognition process will take the segmented components of the aforementioned image and convert them into an ASCII text field. In the identification process, it will be determined whether or not the ASCII information is in the correct format. Now the extracted information will be placed in processed mail data buffer 54. Clock and calendar 58 will be used to determine when mail piece 10 was scanned and I/O 57 will be used to convey the information stored in buffer 54 to modem 21 at predetermined times.

The operator of meter 11 may use I/O 17 to select the meter mode to place a postal indicia on mail piece 10 or the scan mode to read the postal indicia on mail piece 10. When the operator of meter 11 selects the meter mode, controller 16 turns control of meter 11 over to meter process controller 51. While mail piece 10 is being printed, it is scanned by scanner 55.

Scanner 55 will store the image of mail piece 10 in buffer 52, while mail piece 10 is being printed by meter 11. Scanner 55 will also convert the image by using the process shown in block 53 and store the processed image in mail data buffer 54. Then the optical character recognition process 53 will begin. Process 53 will segment the image into its various components, i.e., amount of postage, meter number, date mail piece 10 mailed, place mail piece 10 mailed, security code 89, tracking number 7, recipient address 9, and return address 8, etc. At this point, the recognition process will take the segmented components of the aforementioned image and convert them into an ASCII text field. In the identification process, it will be determined whether or not the ASCII information is in the correct format. Now the extracted information will be placed in processed mail data buffer 54. Clock and calendar 6 will be used to note when an indicia was affixed to mail piece 10 and when mail piece 10 was scanned. I/O 56 will be used to convey the information stored in buffer 54 to modem 20 at a predetermined time.

The operator of mail piece opening unit 60 (described in the description of FIG. 8) may use I/O 47 to open mail piece 10 and select the scan mode to read the postal indicia on mail piece 10. When the operator of unit 60 selects the scan mode, controller 64 turns control of unit 60 over to scan process controller 51. Mail piece 10 will be moved under scanner 55 and transported through unit 60 by opener and envelope transport 65 (FIG. 8). Scanner 55 will store the image of mail piece 10 in buffer 52, convert the image by using the process mentioned in block 53 and store the processed image in processed mail data buffer 54. Then the optical character recognition process 53 will begin. Process 53 will segment the image into its various components, i.e., amount of postage, meter number, date mail piece 10 mailed, place mail piece 10 mailed, security code 89, tracking number 7, recipient address 9, and return address 8, etc. At this point, a recognition process will take the segmented components of the aforementioned image and convert them into an ASCII text field. In the identification process it will be determined whether or not the ASCII information is in the correct format. Now the extracted information will be placed in processed mail data buffer 54. Clock and calendar 6,58,66 (FIG. 8) will be used to determine when mail piece 10 was scanned and I/O 56,57 63 will be used to convey the information stored in buffer 54 to modems 21 and 23 at predetermined times.

Figure 3:
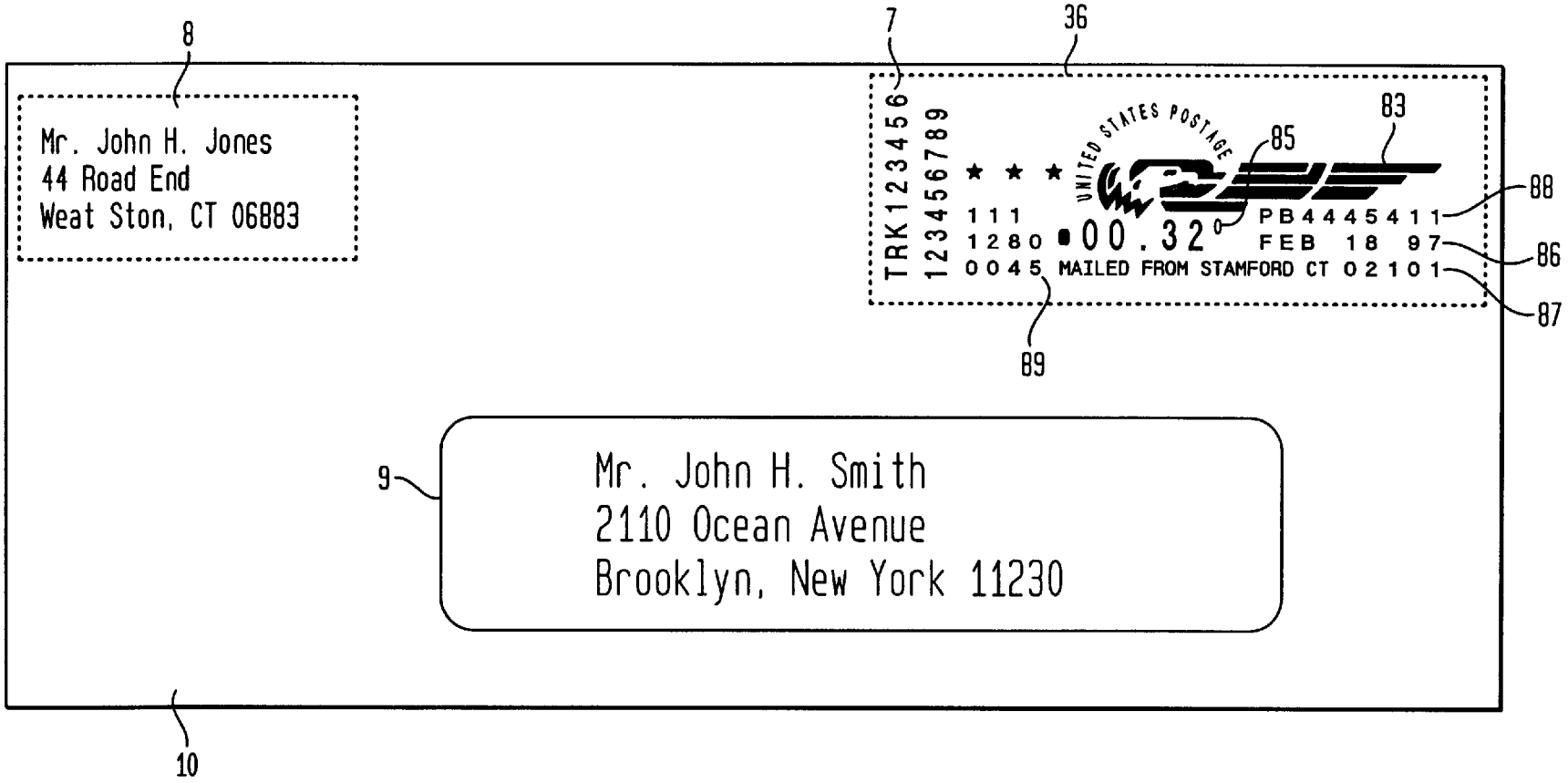
FIG. 3 is a drawing of a mail piece containing a postal indicia that was affixed by a electronic meter.

FIG. 3 is a drawing of a mail piece containing a postal indicia that was affixed by a electronic meter. Mail piece 10 has a recipient address field 9 and a sender address field 8. A postal indicia 36 is affixed to mail piece 10. Indicia 36 contains a dollar amount 85, the date 86, that postal indicia 36 was affixed to mail piece 10, the place 87 that mail piece 10 was mailed, the postal meter serial number 88, an eagle 83, a security code 89 and a tracking number 7. Security code 89 and tracking number 7 are unique numbers that are derived from address field 9 and information contained in the postage meter that affixed indicia 36. The manner in which security code 89 and tracking number 7 are obtained is disclosed in the Sansone et al U.S. Pat. No. 4,831,555 entitled "Unsecured Postage Applying System" herein incorporated by reference. It will be obvious to one skilled in the art that tracking number 7 may be printed in other areas of mail piece 10.

Figure 4:
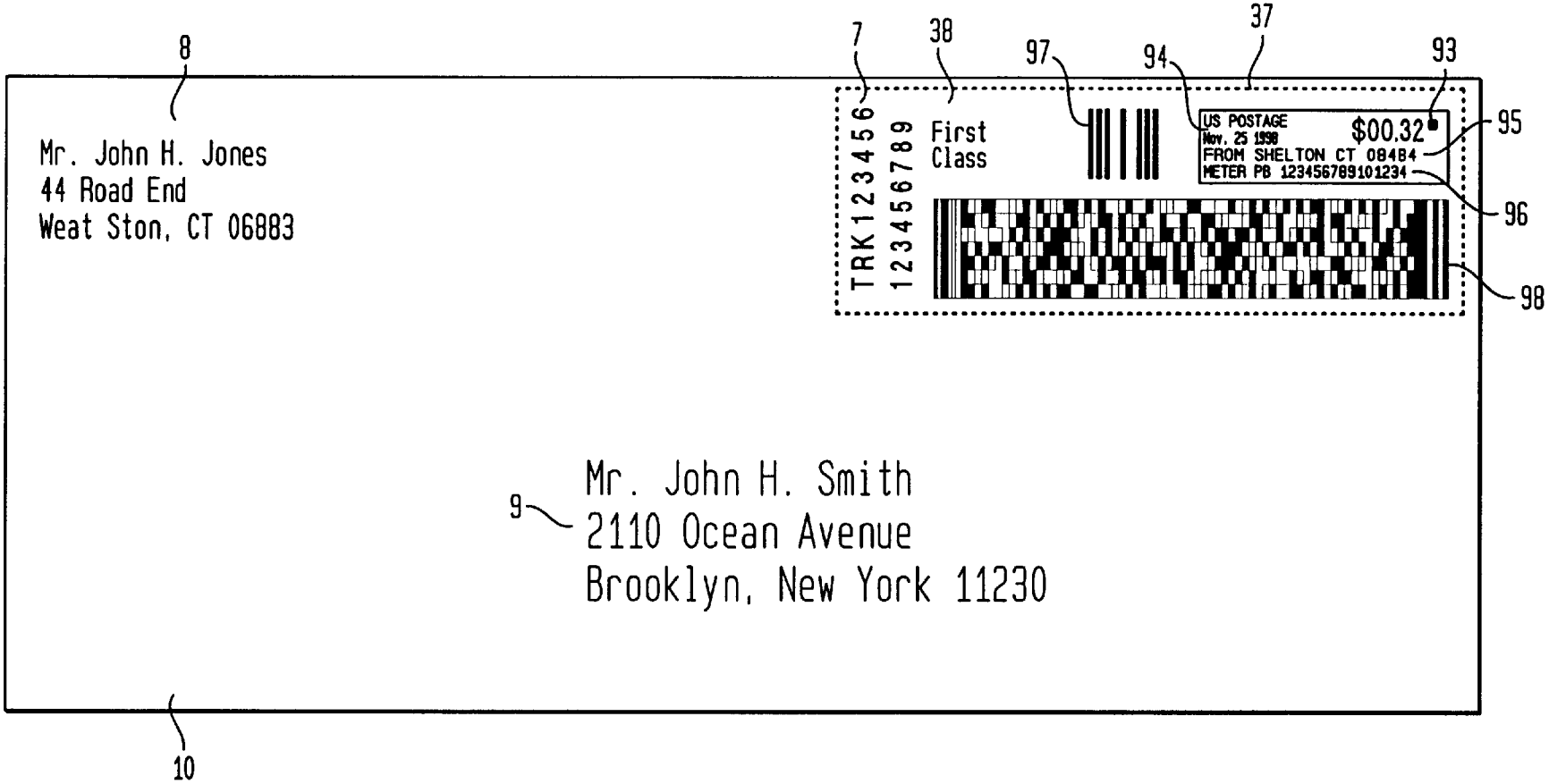
FIG. 4 is a drawing of a mail piece containing a Information-Based Indicia.

FIG. 4 is a drawing of a mail piece 10 containing a indicia 37. Mail piece 10 has a recipient address field 9 and a sender address field 8. Mail piece 10 contains USPS Information-Based Indicia (IBI) 37. The United States Postal Service Engineering Center recently published a notice of proposed specification that describes a Information-Based Indicia. The postal indicia 37 contains a dollar amount 93, the date 94, that the postal indicia was affixed to mail piece 10, the place 95 that mail piece 10 was mailed, the postal security device serial number 96, a FIM code 97; a 2D encrypted bar code 98; and a tracking number 7. Serial number 96 may be derived from bar code 98 or be equal to bar code 98. Bar code 98 is a unique number that is derived from address field 9 and information contained in the postal security device that affixed IBI 37. The manner in which information contained in bar code 98 is obtained is disclosed in the Sansone, et al. U.S. Pat. No. 4,831,555 entitled "UNSECURED POSTAGE APPLYING SYSTEM," herein incorporated by reference. Mail piece 10 also contains an indication 38 of the class of mail piece 10.

Figure 5:
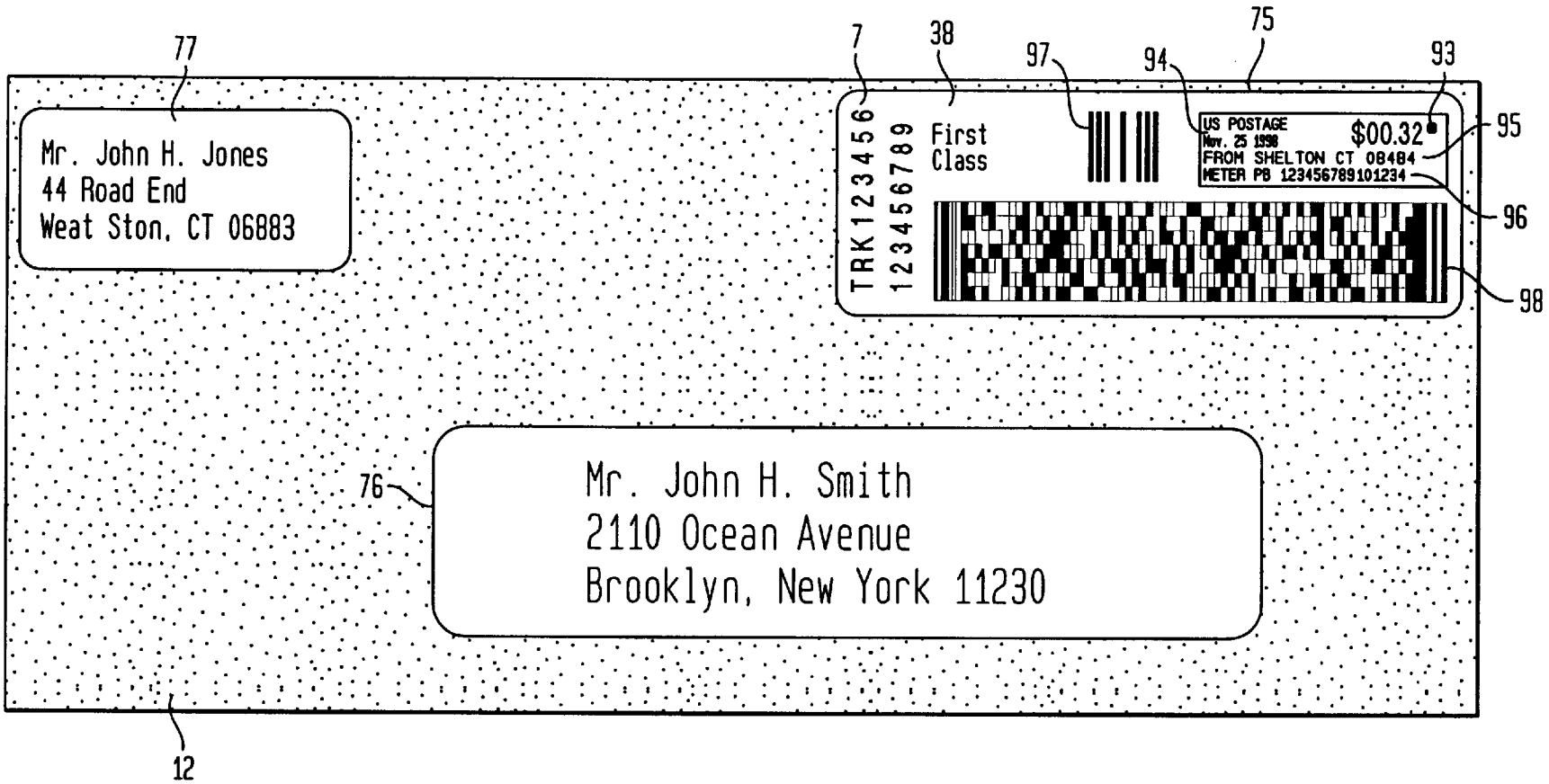
FIG. 5 is a drawing of a mail piece containing an envelope in which the indicia, senders address, recipient address were printed on labels that were affixed to the envelope or on a piece of paper that can be seen through the envelope.

FIG. 5 is a drawing of a mail piece containing an envelope in which the indicia, senders address and recipient address were printed on labels that were affixed to the envelope or on a piece of paper that can be seen through the envelope. FIG. 5 is the same as FIG. 4, except that the return address field 8 is printed on a label 77, indicia 37 is printed on a label 75 and recipient address field 9 is printed on a label 76. Return address field 8, indicia 37, recipient address field 9 may be also printed on paper so that they may be seen through envelope 78.

Figure 6:
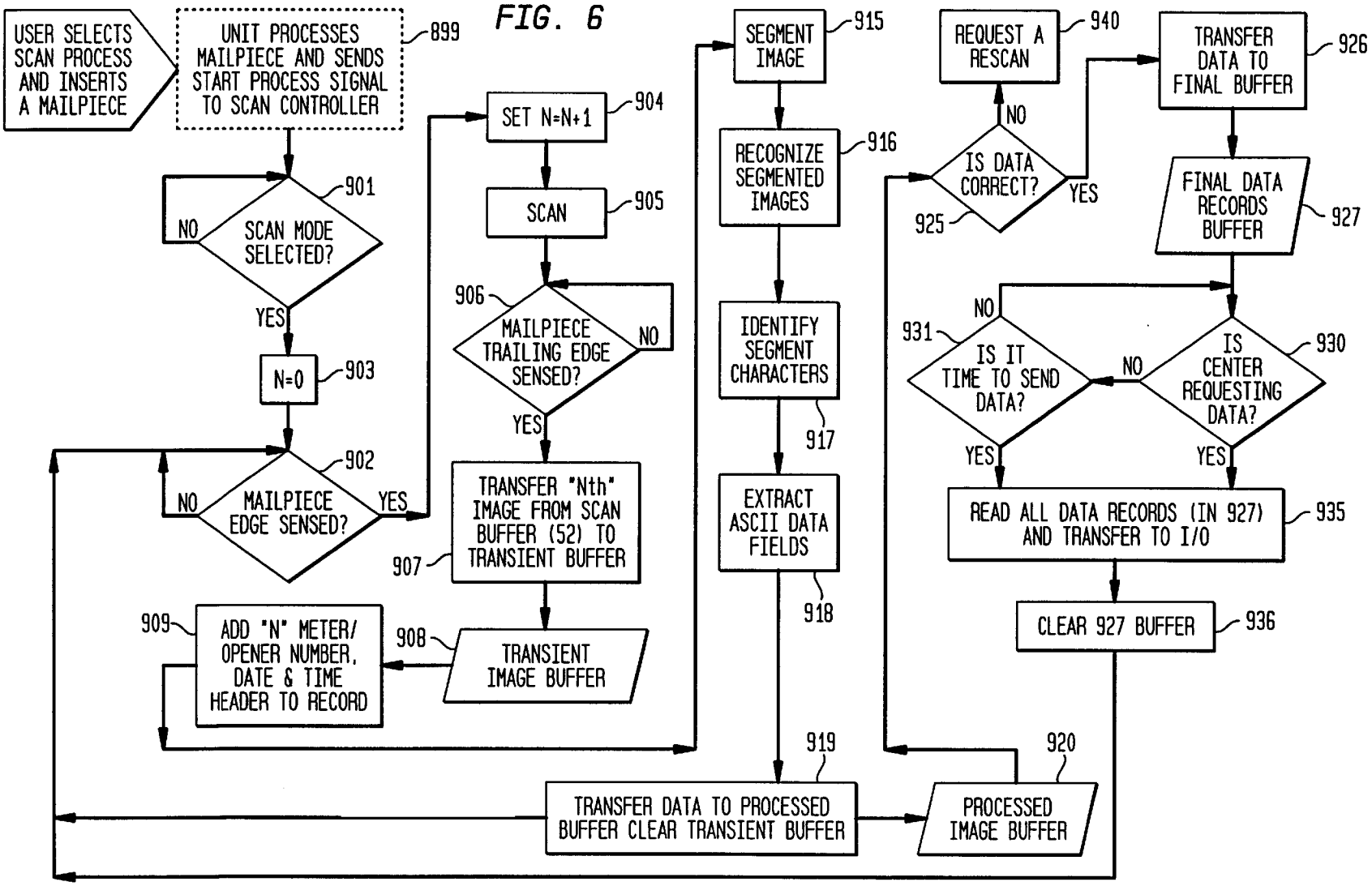
FIG. 6 is a drawing of a flow chart of the scan/upload process.

FIG. 6 is a drawing of a flow chart of the scan/upload process for the meter/opener and PSD. The user selects the scan process and inserts a mail piece for the meter/opener. For the receiving PSD 342 (FIG. 9) the user selects the scan process and inserts a mail piece into scanner 345. Block 899 processes the mail piece and sends a start process signal to the scan controller. This process is used by meter controller 46 of FIG. 1 and letter opener controller 64 of FIG. 8. Then the program goes to block 901. Block 901 determines whether or not the scan mode has been selected. If the scan mode has not been selected then the program goes back to block 901 and processes the mail piece as a conventional meter would. If the scan mode has been selected the program goes to block 903 and sets N=0. Then the program goes to decision block 902. Block 902 determines whether or not the edge of mail piece 10 has been sensed. If the edge of mail piece 10 has not been sensed, then the program goes back to block 902. If the edge of mail piece 10 has been sensed, then the program goes to block 904 to set N=N+1, where N is a piece count of the image of a mail piece.

Now the program goes to block 905 to scan mail piece 10. At this point, the program goes to decision block 906. Block 906 determines whether or not the trailing edge of mail piece 10 has been sensed. If the trailing edge of mail piece 10 has not been sensed then the program goes back to block 906. If the trailing edge of mail piece 10 has been sensed, the program goes to block 907. Block 907 transfers the Nth image from the scan buffer block 52 (FIG. 2) to the transient image buffer block 908. Then the program goes to block 909 to add the N, piece count of the image of the mail piece meter number, date and time to the header for the record. Then the program goes to block 915 to segment the image. Then the program goes to block 916 to recognize segmented images. In block 917, the program identifies the segmented characters. Now the program goes to block 918 to extract ASCII data fields. At this point, the program goes to block 919 to transfer the data to processed buffer block 920 and clear transient buffer block 908. Now the program goes to decision block 902 and to block 920 processed image buffer. Then the program goes to decision block 925. Block 925 determines whether or not the data is correct. If the data is incorrect, the program goes to block 940 to request a rescan. If the data is correct, the program goes to block 926 to transfer the data to the final buffer. Then the program goes to block 927 the final data records buffer. At this point, the program goes to decision block 930. Decision block 930 determines whether or not data center computer 26 is requesting data. If block 930 determines that computer 26 is not requesting data, the program goes to block 931. Block 931 determines whether or not it is time to send data to the center. If block 931 determines that it is time to send data to the center, the program goes to the input of block 935. If block 931 determines that it is not time to send data to the data center, the program goes back to the input of block 930. If block 930 determines that computer 26 is requesting data, then the program proceeds to block 935. Block 935 reads all final data records in block 927 and transfers them to I/O 56, 57 or 63.

Now the program goes to block 936 to clear final data buffer records block 927. Then the program goes back to decision block 902.

Figure 7:
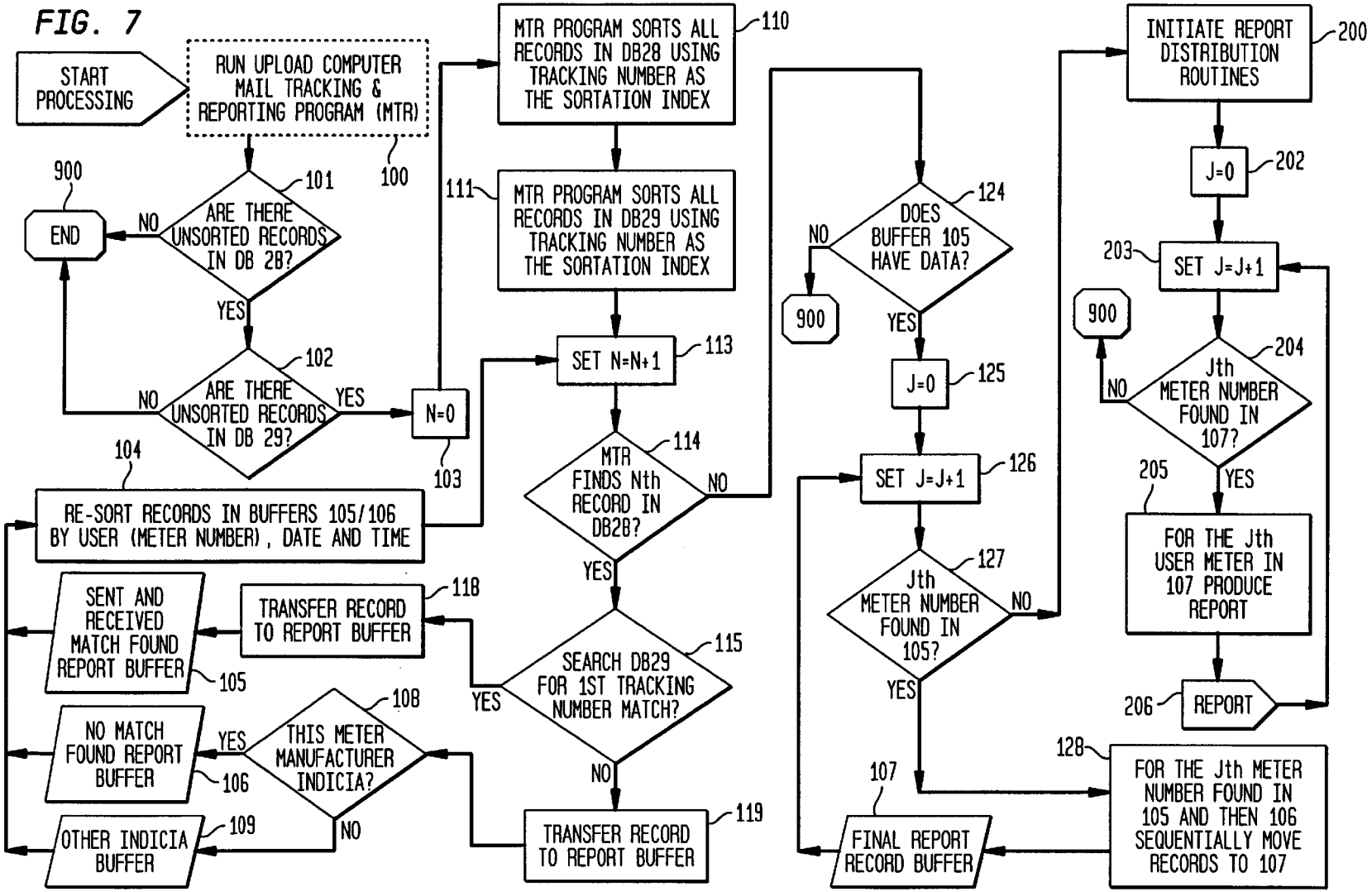
FIG. 7 is a drawing of a flow chart of the data center process.

FIG. 7. is a flow chart of the upload computer mail tracking reporting program. The program starts in block 100 run. Then the program goes to block 101 to determine whether or not there are any unsorted records in outbound mail data buffer 28 (FIG. 1). If there are no unsorted records in buffer 28, the program goes to block 900 and ends. If block 101 determines that there are unsorted records in buffer 28, the program proceeds to decision block 102. Decision block 102 determines whether or not there are any unsorted records in inbound mail data buffer 29 (FIG. 1). If there are no unsorted records in buffer 29, the program goes to block 900 and ends. If block 102 determines that there are unsorted records in buffer 29, the program proceeds to block 103 to set N=0. Now the program goes to block 110 to sort all records in buffer 28 using tracker number 7 as the sortation index. Now, the program goes to block 111 to sort all the records in buffer 29 using tracking number 7 as the sortation index. At this point, the program goes to block 113 to set N=N+1. Now the program goes to decision block 114 to select the next ID record in buffer 28. If there are no records in buffer 28, then the program goes to decision block 120. If there are records in buffer 28, the program goes to decision block 115. Decision block 115 searches inbound mail data buffer 29 and determines whether or not it found the first tracking number match.

If decision block 115 determines that there are no ID numbers that match in buffer 29, then the program goes to block 119. Block 119 transfers the record to decision block 108. Decision block 108 determines whether or not the indicia on mail piece 10 was produced by the meter manufacturer that manufactured meter 11 or the PSD manufacturer that manufactured PSD 312.

If block 108 determines that it is not the same manufacturer, the record is transferred to other indicia buffer 109. Block 109, which holds other meter and PSD manufacturer data, is emptied.

Periodically with the files being sent to each of the other manufacturers or to the post. If block 108 determines that it is the same manufacturer, the record is transferred to block 106. Block 106 holds the no match found records. If decision block 115 finds the first tracking number match, then the program goes to block 118. Block 118 transfers record to report buffer 105. Block 105 stores the sent and received match found records.

Block 105 and block 106 sends the reports to block 104. Block 104 re-sorts the records in buffers 105 and 106 by user (meter number or unit number) date and time. If decision block 114 was unable to find the Nth record in buffer 28, the program goes to decision block 124. Decision block 124 determines whether or not buffer 105 has data. If block 124 determines that buffer 105 has no data, the program goes to block 900 and ends. If block 124 determines that buffer 105 has data, the program goes to block 125 to set J=0. Where J is a record number.

Now the program goes to block 126 to set J=J+1. Then the program goes to decision block 127. Decision block 127 determines whether or not the Jth meter number was found in block 105. If block 127 determines that the Jth number was found, the program goes to block 128. For the Jth meter number found in block 105 and block 106, block 128 reads all the records and transfers them to block 107. Block 107 compiles a final report of the record buffer. Then the program goes back to block 126 to set J=J=1.

If decision block 127 did not find the Jth number in block 105 the program goes to block 200 to initiate report distribution routines. Now the program goes to block 202 to J=0. Then the program proceeds to block 203 to set J=J+1. Now the program goes to decision block 204. Decision block 204 determines whether or not the Jth number is in block 105. If the Jth number is not in block 105, the program goes to block 900 and ends. If the Jth number is in block 105, the program goes to block 205. Block 205 produces a report for the Jth user meter or unit in block 107. The report may be sent to the meter user, post, etc. After the report is produced, the program goes back to block 203 to set J=J+1 so as to produce the next report.

FIG. 8 is a block diagram of an alternate embodiment of this invention. Postage meter 11 includes: a funds vault 99, that represents the value of the postage that may be used by meter 11; an accounting and encryption module 13, that contains information that is used to print indicia 18; a printer 14; a scanner and processor 15; a controller 16; a clock and calendar 6; a user I/O 17, and a I/O 56. Accounting and encryption module 13 obtains a security code that may be obtained from address field 9 of mail piece 10 and information contained in postage meter 11. User I/O 17 comprises a keyboard in which an operator may enter information into meter 11 and a display in which a operator of meter 11 may read information about meter 11. Funds vault 99, accounting and encryption module 13, indicia printer 14, scanner and processor 15, clock and calendar 6, and user I/O 17 are coupled to controller 16. Clock and calendar 6 provides an internal source of time and date for controller 16. Thus, clock and calendar 6 will supply the instant date and time that meter 11 affixed the indicia to mail piece 10. Scanner and processor 15 will store the above information in buffer 54 (described in the description of FIG. 2).

Actions performed by meter 11 are communicated to controller 16. Controller 16 controls the actions of postage meter 11. Clock and calendar 6 also permit controller 16 to store the date and time that postal indicia 18 was affixed to mail piece 10. Controller 16 uses the weighing of the mail piece to determine the correct postage, and causes meter 11 to affix the correct postage to the mail piece.

The user of meter 11 places the mail piece to be mailed on a scale (not shown) and enters the classification of the material to be mailed, i.e., first class mail, second class mail, parcel post, etc. into the keyboard of I/O 17 and relevant information regarding the object to be mailed is displayed on the display of I/O 17.

Printer 14 will print postal indicia 18 on mail piece 10. Scanner and processor 15 scans address field 9 and sender return address field 8 of mail piece 10. Then scanner and processor 15 segments the information contained in fields 8 and 9 and stores the segmented information, i.e., tracking code 7. Tracking code 7 may be similar to or the same as the security code determined by accounting encryption module 13. It will be obvious to one skilled in the art that there are many different methods to produce unique tracking numbers.

I/O 56 is coupled to modem 20 and scanner and processor 15. Modem 23 is coupled to modem 20 via communications path 24 and modem 21 is coupled to modem 23 via communications path 25. Modem 23 is coupled to postage meter data center computer 26. Computer 26 manages the day to day operation of its postage meters metering, i.e., installing new postage meters, withdrawing postage meters, and refilling postage meters with customer funds.

Computer 26 is coupled to: postal funds data base 27. Data base 27 stores postal funds that have been used and credited to meters 11 and 41. Outbound mail data buffer 28 receives information about mail piece 10 from postage meter 11, i.e., tracking number 7 and address field 9. Inbound mail buffer 29 receives information about mail piece 10 from postage meter 41, i.e., tracking number 7 and address field 9. Upload data computer 30 receives and processes information from buffers 28 and 29. Processed mail data base 31 is coupled to upload data computer 30. Processed mail data base 31 stores the result of the output of computer 30 and makes it available to computer 26 for transmission to meter 11. Modem 23 is coupled to modem 129 which is coupled to postal data center 130 so that information from upload data computer 30 may be transmitted to postal data center 130.

Mail piece opening unit 60 includes: a scanner and processor 61; a mail piece opener controller 64; a clock and calendar 66 that permits controller 64 to store the date and time that scanner 61 scanned mail piece 10; a user I/O 62; and a I/O 63. Scanner and processor 61; user I/O 62, and opener and mail piece transport 65 are coupled to controller 64. I/O 63 is the interface between scanner and processor 61 and modem 21 and is used to upload data from unit 60 to computer 26 via modems 21 and 23. Clock and calendar 66 will supply the instant date and time that scanner 61 reads mail piece 10. The above information will be stored in buffer 54 of FIG. 2. Opener and mail piece transport 65 will be used to open mail piece 10, if mail piece 10 is an envelope. Transport 65 is described in Luperti's U.S. Pat. No. 3,828,634 entitled "Automatic Envelope Opener", herein incorporated by reference.

Thus, in this example, unit 60 is being used as a receiving unit. After indicia 18 is affixed to mail piece 10 by postage meter 11, mail piece 10 is delivered to the post and enters USPS mail delivery process 32. The post delivers mail piece 10 to the owner of unit 60. Mail piece 10 will be scanned by scanner and processor 61 of unit 60. Scanner and processor 61 segments the data and stores it for uploading to computer 26 via modems 21 and 23. Information from unit 60 regarding mail piece 10 was previously sent to computer 26 via modems 20 and 23. The information transmitted by unit meter 11 is tracking number 7 and address field 9. The information transmitted by unit 60 is tracking number 7 and address field 9, the date and time mail piece 10 was scanned by meter 41 and the serial number of meter 41.

Figure 9:
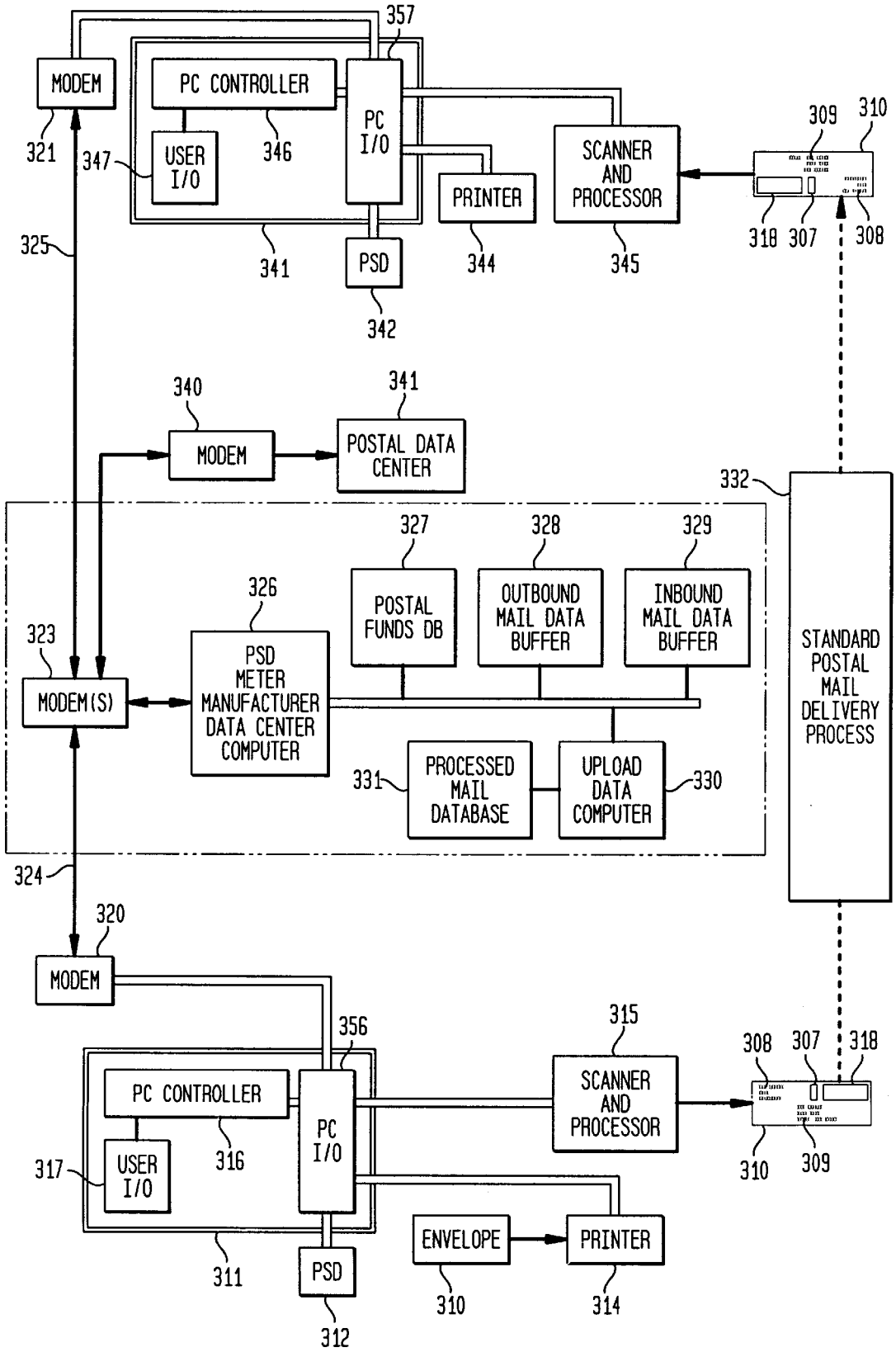
FIG. 9 is a block diagram of a PSD based PC mailing system.

FIG. 9 is a block diagram of a PSD based PC mailing system. Personal computer (PC) 311 includes: a PC controller 316; a user I/O 317; and a PC I/O 356. PSD 312 obtains a security code that may be obtained from address field 309 of mail piece 310 and information contained in PC 311. User I/O 317 comprises a keyboard in which an operator may enter information into PC 311 and a display in which a operator of PC 311 may read information about PC 311. A clock and calendar inside PSD 312 will supply the instant date and time that printer 314 affixed the indicia to mail piece 310. Scanner and processor 315 will store the above information in PC 311.

Actions performed by PC 311 are communicated to controller 316. Controller 316 controls the actions of PC 311. Controller 316 uses the weighing of the mail piece to determine the correct postage, and causes printer 314 to affix the correct postage to mail piece 310.

The user of PC 311 places the mail piece to be mailed on a scale (not shown) and enters the classification of the material to be mailed, i.e., first class mail, second class mail, parcel post, etc. into the keyboard of I/O 317 and relevant information regarding the object to be mailed is displayed on the display of I/O 317.

Printer 314 will print postal indicia 318 on mail piece 310. Scanner and processor 315 scans address field 309 and sender return address field 308 of mail piece 310. Then scanner and processor 315 segments the information contained in fields 308 and 309 and stores the segmented information, i.e., tracking code 307. Tracking code 307 may be similar to or the same as the security code determined by PSD 312. It will be obvious to one skilled in the art that there are many different methods to produce unique tracking numbers.

I/O 356 is coupled to modem 320 and scanner and processor 315. Modem 323 is coupled to modem 320 via communications path 324 and modem 321 is coupled to modem 323 via communications path 325. Modem 323 is coupled to PSD data center computer 326. Computer 326 manages the day to day operation of its PSDs metering, i.e., installing new PSDs, withdrawing PSDs, and refilling PSDs with customer funds.

Computer 326 is coupled to: postal funds data base 327. Data base 327 stores postal funds that have been used and credited to PC 311 and 341; outbound mail data buffer 328, that receives information about mail piece 310 from PC 311, i.e., tracking number 307 and address field 309; inbound mail buffer 329, that receives information about mail piece 310 from PC 341, i.e., tracking number 307 and address field 309; and upload data computer 330, that receives and processes information from buffers 328 and 329. Processed mail data base 331 is coupled to upload data computer 330. Processed mail data base 331 stores the result of the output of computer 330 and makes it available to computer 326 for transmission to PC 311. Modem 323 is coupled to modem 340 which is coupled to postal data center 341 so that information from upload data computer 330 may be transmitted to postal data center 341.

PC 341 includes: a PC controller 346; user I/O 347; and PC I/O 357. PSD 342 is coupled to PC I/O 357. PC I/O is coupled to modem 321 and modem 321 is coupled to modem 323 via path 325. Scanner and processor 345 is coupled to PC I/O 357 and printer 344 is coupled to PC I/O 357. PSD 342 will supply the instant date and time that scanner 345 reads mail piece 310. The above information will be stored in PC 311.

Thus, PC 341 is the same as PC 311. In this example PC 341 is being used as the receiving PC and PC 311 is being used as a sending PC. It will be obvious to those skilled in the art that PC 311 may be a receiving PC and PC 341 a sending PC and that additional PCs may be connected to computer 326.

After indicia 318 is affixed to mail piece 310 by PC 311, mail piece 310 is delivered to the post and enters USPS mail delivery process 332. The post delivers mail piece 310 to the owner of PC 341. Mail piece 310 will be scanned by scanner and processor 345 of PC 341. Scanner and processor 345 segments the data and stores it for uploading to computer 326 via modems 321 and 323. Information from PC 311 regarding mail piece 310 was previously sent to computer 326 via modems 320 and 323. The information transmitted by PC 311 includes tracking number 307 and address field 309. The information transmitted by PC 341 includes tracking number 307 and address field 309, the date and time mail piece 310 was scanned by PC 341 and the serial number of PC 341.

The above specification describes a new and improved system for metering incoming mail. It is realized that the above description may indicate to those skilled in the art additional ways in which the principles of this invention may be used without departing from the spirit. It is, therefore, intended that this invention be limited only by the scope of the appended claims.

What is claimed is:

1. An incoming mail monitoring system, said system comprises:

a plurality of mailers digital units that stores unique information contained in postal indicia of a mail piece;

a plurality of recipient units that reads and stores the unique information contained in the postal indicia after the mail piece has been delivered to the recipient; and a data center that receives and correlates information stored by the mailers units and the recipients units to determine if the mail piece has been delivered.

2. The system claimed in claim 1, wherein the mailers unit correlates the mail piece recipient address with unique information contained in the postal indicia.

3. The system claimed in claim 1, wherein the recipients unit includes a scanner that reads the postal indicia.

4. The system claimed in claim 1, wherein the data center processes the received information.

5. The system claimed in claim 1, wherein the mailers unit includes means for automatically transmitting information to the data center at predetermined intervals.

6. The system claimed in claim 1, wherein the recipients unit includes means for automatically transmitting information to the data center at predetermined intervals.

7. The system claimed in claim 1, wherein the postal indicia is on a label that is affixed to the mail piece.

8. The system claimed in claim 1, wherein the postal indicia is printed on a piece of paper that may be seen through a envelope forming the mail piece.

9. The system claimed in claim 1, wherein the unique information is encrypted.

10. The system claimed in claim 1, wherein the unique information is printed in an area other than the indicia area of the mail piece.

11. The system claimed in claim 1, wherein the mailers units are digital postage units.

12. The system claimed in claim 1, wherein the mailers units are Postal Security Devices.

13. The system claimed in claim 1, wherein the recipients units are digital postage units.

14. The system claimed in claim 1, wherein the recipients units are Postal Security Devices.

15. The system claimed in claim 1, wherein the mailers unit includes a scanner that reads the postal indicia.

16. The system claimed in claim 15, wherein the scanner produces a record indicating that a specific indicia was produced.

17. The system claimed in claim 1, wherein the data center further includes: means for sorting the information received from each of the mailers units by the mailers unit that sent the information.

18. The system claimed in claim 17, wherein the data center further includes: means for sorting the information received from each of the recipient units by the recipient unit that sent the information.

19. The system claimed in claim 18, wherein the data center further includes: means for routing the information obtained from the recipients unit regarding mail pieces received from the mailers unit to the mailers unit.

20. The system claimed in claim 19, wherein the data center further includes: means for routing the information obtained from the mailers unit regarding mail pieces received by the recipients unit to the recipients unit.

21. The system claimed in claim 20, wherein the data center further includes: means for charging the recipients unit for receiving the routed information.

22. The system claimed in claim 21, wherein the data center further includes: means for charging the mailers unit for receiving the routed information.

23. The system claimed in claim 22, wherein the data center further includes: means for crediting the mailers unit for sending information to the data center.

24. The system claimed in claim 23, wherein the data center further includes: means for crediting the recipients unit for sending information to the data center.

25. The system claimed in claim 24, wherein the data center further includes: means for informing the mailers unit of the time that the recipients unit read the indicia of time sensitive mail.

26. The system claimed in claim 1, wherein the mailers unit includes the time and date that the postal indicia was affixed to the mail piece in the unique information contained in the postal indicia.

27. The system claimed in claim 26, wherein the recipients unit stores the time and date that the recipient meter read the postal indicia.

28. The system claimed in claim 27, wherein the data center further includes: means for informing the mailers unit when the mail piece was received by the recipients unit.

29. The system claimed in claim 27, wherein the data center determines the amount of time that has elapsed between the time the postal indicia was affixed to the mail piece and the time that the recipient unit read the postal indicia.

30. The system claimed in claim 29, wherein the data center further includes: means for informing the mailers unit of the amount of time that has elapsed between the time the postal indicia was affixed to the mail piece and the time that the recipient unit read the postal indicia.

31. The system claimed in claim 29, wherein the data center further includes: means for informing the post of the amount of time that has elapsed between the time the postal indicia was affixed to the mail piece and the time that the recipient unit read the postal indicia.

32. The system claimed in claim 29, wherein the data center further includes: means for charging the post to inform the post of the amount of time that has elapsed between the time the postal indicia was affixed to the mail piece and the time that the recipient unit read the postal indicia.

33. The system claimed in claim 29, wherein the data center further includes: means for informing the post of mail pieces that have not been read by recipients units after specified periods of time.

34. The system claimed in claim 29, wherein the data center further includes: means for informing the mailers unit of mail pieces that have not been read by recipients units after specified periods of time.

35. The system claimed in claim 29, wherein the recipients unit prints the date and time that it read the postal indicia on the mail piece.

36. The system claimed in claim 35, wherein the recipients unit includes means for opening envelopes.

37. A incoming mail monitoring system, said system comprises:

a plurality of mailers digital postage meters that stores unique information contained in a postal indicia of a mail piece;

a plurality of recipient addressee mail piece units that reads and stores the unique information contained in the postal indicia after the mail piece has been delivered to the recipient; and a data center that receives and correlates information stored by the mailers meters and the recipients meters to determine if the mail piece has been delivered.

38. The system claimed in 37, wherein the recipient mail piece unit includes an opener to open the mail piece.

* * * * *